US005429868A

United States Patent [19]

Truckenmüller et al.

[11] Patent Number: 5,429,868

[45] Date of Patent: Jul. 4, 1995

[54] YARN, ESPECIALLY SEWING YARN, AND METHOD OF PRODUCING SAME

[75] Inventors: Kurt Truckenmüller; Karl Greifeneder, both of Heilbronn, Germany

[73] Assignee: Amann & Sohne GmbH & Co., Bonnigheim, Germany

[21] Appl. No.: 229,992

[22] Filed: Apr. 18, 1994

Related U.S. Application Data

[63] Continuation of Ser. No. 95,939, Jul. 22, 1993, abandoned, which is a continuation of Ser. No. 744,889, Aug. 14, 1991, abandoned.

[30] Foreign Application Priority Data

| | | | |
|---|---|---|---|
| Aug. 17, 1990 | [DE] | Germany | 40 26 069.0 |
| Nov. 19, 1990 | [DE] | Germany | 40 36 798.3 |
| Jun. 29, 1991 | [DE] | Germany | 41 21 638.5 |

[51] Int. Cl.[6] ..... D02G 3/00

[52] U.S. Cl. ..... 428/357; 428/370; 428/399; 57/210; 57/227; 57/243; 57/244; 57/903; 57/905; 57/247

[58] Field of Search ..... 428/364, 370, 373, 399, 428/357; 57/6, 224, 247, 243, 244, 210, 903, 905, 227; 28/254, 257, 258–271

[56] References Cited

U.S. PATENT DOCUMENTS

| | | | |
|---|---|---|---|
| 3,811,263 | 5/1974 | Newton | 28/258 |
| 4,226,079 | 10/1980 | Mountney et al. | 28/258 |
| 4,497,099 | 2/1985 | Scott | 57/6 |
| 4,615,167 | 10/1986 | Greenberg | 57/6 |
| 5,083,419 | 1/1992 | Greifeneder et al. | 57/6 |
| 5,100,729 | 3/1992 | Jacob et al. | 428/373 |

FOREIGN PATENT DOCUMENTS

| | | | |
|---|---|---|---|
| 0363798 | 10/1989 | European Pat. Off. . | |
| 2902949 | 8/1979 | Germany . | |
| 3140030 | 4/1983 | Germany . | |
| 1052841 | 2/1989 | Japan | 57/903 |
| 2043718 | 10/1980 | United Kingdom . | |

*Primary Examiner*—Patrick J. Ryan
*Assistant Examiner*—N. Edwards
*Attorney, Agent, or Firm*—Meltzer, Lippe, Goldstein, Wolf, Schlissel & Sazer

[57] ABSTRACT

A yarn, especially a sewing yarn, comprises at least two multifile yarn components. The first yarn component forms mainly the core of the yarn and the second yarn component forms mainly the jacket of the yarn. The two yarn components are intermingled with one another. The monofilaments of the second yarn component have a specific strength which amounts to between 5% and 70%, especially between 10% and 50%, of the specific strength of the monofilaments of the first yarn component.

27 Claims, 2 Drawing Sheets

YARN, ESPECIALLY SEWING YARN, AND METHOD OF PRODUCING SAME

This is a continuation of application Ser. No. 08/095,939, filed Jul. 22, 1993, now abandoned, which is a continuation of application Ser. No. 07/744,889, filed Aug. 14, 1991, now abandoned.

BACKGROUND OF THE INVENTION

The present invention is directed to a yarn, especially a sewing yarn.

A plurality of yarns with different constructions as well as corresponding methods of producing the same are known. So, on principle such yarns can be spun from multifilament fibers, from staple fibers or from a mixture of multifilament fibers and staple fibers, wherein such a yarn can be additionally threaded in order to improve the thread cohesion and thus the durability of the yarn with regard to mechanical stresses.

In the field of application of the sewing yarns often threads are used consisting of at least two, normally multifile yarn components, wherein these two yarn components threaded with one another are equally formed not only with regard to the number of elementary threads and the titre but also with regard to the strength (tensile strength).

Furthermore, yarns, especially also sewing yarns, are known which have been formed from at least two multifile yarn components, wherein, for the manufacture of such a yarn, the two yarn components are intermingled with one another by means of a fluid stream such that the first yarn component is mainly located within the core of the spun yarn and is thus also designated core component, while the second yarn component is mainly located in the outer area of the spun yarn and is thus designated jacket component or covering. In such core-jacket-yarns the jacket component has a significantly greater length which has the result that the jacket component (covering) gives such a core-jacket-yarn a certain volume since slings, self-crossing loops and/or arcs are formed. Normally, these core-jacket-yarns have excellent characteristics with regard to the mechanical durability so that they are more and more used for sewing yarns which are exposed to extreme mechanical stresses during their processing.

In order to attain the necessary strength with the above-described yarns German disclosure letter 3 834 139 suggests to form the core yarn component and the jacket yarn component of the same ultra-strong material. Here, the specific strength (tensile strength) of the multifile core yarn component and of the multifile jacket yarn component amounts to at least 40 cN/tex, preferably more, according to German disclosure letter 3 834 139.

The present invention is based on the problem to provide a core-jacket-yarn of the cited kind which has an especially good mechanical durability.

SUMMARY OF THE INVENTION

The inventive yarn, which is especially used as sewing yarn, includes at least two multifile yarn components, wherein the first yarn component forms mainly the core of the yarn and the second yarn component forms mainly the jacket of the yarn. The two yarns are intermingled with one another, which has the result that the core material extends linearly or nearly linearly, viewed in axial direction of the spun yarn, while the multifile jacket yarn (covering) is intermingled with the core yarn with the formation of slings, self-crossing loops and/or arcs and covers this core yarn completely or nearly completely so that such a yarn has a certain volume and thus a certain bulkiness. With the inventive yarn the monofilaments of the second yarn component have a specific strength (tensile strength) which amounts to between 5% and 70%, especially between 10% and 50%, of the specific strength of the monofilaments of the first yarn component.

The inventive yarn has a number of advantages. So, it could be observed that such a yarn can be processed especially well, i.e. without thread breakage. It appears that the reason for this is that with the inventive yarn no thread material shiftings (by broken and shifting filaments) occur, which are considered the pre-stage for a thread breakage. It was rather observed with the inventive yarn that several filaments which stick to certain machine parts during the processing, for instance to deflection rollers, thread brakes of the needle of a sewing machine etc., do not have the result of undesired thread material shiftings, as this is the case with a conventional yarn, and thus do not have the result of a breakage of the complete yarn. They rather broke immediately due to their above-cited low specific strength so that the inventive yarn, despite of its relatively high bulkiness which significantly increases the danger that the monofilaments stick to one another, has an excellent durability with regard to mechanical stresses. In other words, with the inventive yarn the jacket is made of a material the monofilaments of which have a low strength (tensile strength), wherein these monofilaments already break if they hook to one another in a slight manner, so that the formation of thread material shiftings and thus also the subsequent breakage of the entire thread is prevented.

The superiority of the inventive yarn compared with a conventionally designed intermingled core jacket yarn becomes especially evident if a sewing yarn is made from the inventive yarn. It could be observed by means of high velocity video exposures during sewing that according to the inventive sewing yarn the monofilaments of the jacket hooking to sewing machine parts, especially the gripper and/or the needle, broke immediately during sewing on account of the predetermined low specific strength, without the result of a significant braking of the forward movement of the sewing yarn. Furthermore, it was observed with the inventive yarn that the loop formation of the needle thread necessary for sewing took place correctly, even upon hooking of projecting monofilaments. In contrast to this, the conventional sewing yarn was significantly braked when the projecting filaments hooked since the hooked monofilaments did not break so that corresponding thread material shiftings were formed and subsequently the entire yarn broke or the yarn did not sew since the above-cited loops of the needle thread were not formed or were only sufficiently formed. Accordingly, the inventive yarn has a significantly improved sewing behaviour compared with a conventional sewing yarn, i. e. compared with the conventional sewing yarn, it is possible with the inventive sewing yarn to produce a button hole number which is up to about 50% higher or seams which are longer for 40 to 60% without breakage of the yarn on industrial sewing conditions (5000 to 7000 stitches per minute).

On principle, there are two alternatives in order to obtain the above-cited lower specific strengths of the monofilaments with the inventive sewing yarn.

The first alternative provides that a multifile yarn component is used for the jacket which, viewed along its axial length, has already per se the above-cited specific strength.

According to the second alternative the inventive yarn has monofilaments in the jacket which, viewed in axial direction, have first areas in which the specific strength of the monofilaments is between 5% and 70%, especially between 10% and 50%, related to the specific strength of the monofilaments of the first yarn component. In other words, preferably all the monofilaments of the jacket have a plurality of predetermined breaking points viewed in axial direction so that upon hooking of the monofilaments during the processing, the same can break in these first areas (predetermined breaking points), whereby the formation of thread material shiftings and breakage of the entire yarn are prevented.

An embodiment of the inventive yarn belongs to the above-cited first alternative according to which the first and the second yarn component consist of the same material. Furthermore, the material of the second yarn component has a degree of polymerization which is lower than the degree of polymerization of the material of which the first yarn component consists. Preferably, according to this embodiment such a multifile synthetic material, for example of polyester, nylon 6, nylon 66, polyethylene or polypropylene, is used as second yarn component (jacket component) the mean molecular weight of which is between 5% and 50%, especially between 15% and 25%, below the mean molecular weight of the synthetic fiber material of the first yarn component, wherein the mean molecular weights are customarily determined viscosimetrically by means of the known standards.

A preferred embodiment of the inventive yarn has a second yarn component according to which all the monofilaments or at least the outer monofilaments of the cross-section of the yarn, which give the yarn a certain volume by the formation of the above-cited slings, self-crossing loops or arcs, have an absolute monofilament strength smaller than 3.5 cN. Especially with sewing yarns, it could be observed that the sewing characteristics of the inventive sewing yarn are especially good if the sewing yarn comprises a second yarn component the absolute monofilament strength of which is between 0.5 cN and 3 cN, especially between 0.8 cN and 2 cN. Here, it is not of importance whether these absolute monofilament strengths are achieved by the fact that the multifilaments have corresponding first areas, i. e. predetermined breaking points, or that the multifilaments have the above-cited uniform monofilament strengths along their whole lengths.

As regards the monofilament titre of the filaments of the second yarn component, it has to be stated in connection with the inventive yarn that preferably such multifilament yarns are used herefor the monofilament titre of which varies between 0.4 dtex and 1.4 dtex, especially between 0.5 dtex and 0.7 dtex. Multifile second yarn components having such a fine monofilament titre assure that the filaments break upon a low mechanical load due to hooking so that the formation of thread material shiftings and, as a result herefrom, the occurrence of yarn breakages are prevented with the inventive yarn.

However, as a matter of course the monofilament titre of the second yarn component can be higher than the above-cited titres, especially in a range between 1.4 dtex and 2.5 dtex, with the inventive yarn. It has to be only assured that the monofilaments break at a hooking occuring during the processing.

As regards the strength of the first yarn component which is predominantly located within the interior of the yarn, viewed across the cross-section of the inventive yarn, and which is completely or nearly completely covered by the second yarn component (jacket), it has to be generally stated that the strength of the first yarn component depends on the respective purpose of application of the finished yarn. Customarily, multifilaments having a specific strength of between 40 cN/tex and 270 cN/tex are used for this. It could be particularly observed that, for example, sewing yarns for normal sewing operations meet the requirements with regard to the load carrying ability during sewing completely if the specific strength of the multifilaments of the first yarn component is between 60 cN/tex and 120 cN/tex. For special sewing objectives, for example for the sewing of a security belt or of an air bag, preferably such sewing yarns are used the first multifile yarn component of which has a specific strength between 120 cN/tex and 270 cN/tex.

As regards the material of the first yarn component of the inventive yarn, it has to be stated that any multifilament yarn is suitable herefor which has especially the above-cited strengths. In this connection, especially the ultra-strong polyester types with a specific strength up to 90 cN/tex, nylon 6 with a specific strength of also up to 90 cN/tex, polyethylene and polypropylene with specific strengths of up to 80 cN/tex, ultra-strong polyethylene fibers, especially the ultra-strong polyethylene fibers spun from a gel, with a specific strength of 270 cN/tex, aromatic polyamide fibers (aramides) with a specific strength of 230 cN/tex, carbon fibers, glass fibers and/or silicate fibers are to be denominated. By the covering of the above-cited core materials, which partly can be dyed only in a very difficult and expensive manner, with the above-cited fibers of the second yarn component, it becomes possible to provide a yarn which, in addition to the excellent mechanical durabilities already cited several times above, is uniformly dyed with still normal efforts with regard to the outer colour impression, since the jacket, consisting for example of multifilaments of polyester, nylon 6, nylon 6.6 or polyacrylnitrile, which can be dyed well and simply nearly completely or completely, covers the core material which can be dyed only badly, so that these colour differences between the core material, which is not dyed or badly dyed through, and the jacket, which is well and uniformly dyed, do not macroscopically appear in the finished yarn, especially sewing yarn.

The monofilament titre of the first yarn component varies according to the inventive yarn between about 0.4 dtex and 5 dtex, preferably between 0.8 dtex and 4 dtex.

The elementary thread number of the first yarn component is between 16 and 300, especially between 24 and 96, while the second yarn component has at least a multifilament yarn having an elementary thread number varying between 20 and 400, especially between 36 and 120.

With regard to the entire titre of the inventive yarn it has to be stated that the same varies between 50 dtex and 500 dtex, preferably between 80 dtex and 300 dtex.

According to an especially suitable embodiment of the inventive yarn which is preferably used as sewing yarn, the weight ratio of the first yarn component to the second yarn component is between about 90:10 to about 50:50, preferably between about 80:20 up to about 60:40.

Above, hooking of monofilaments during the processing of the yarn has been mentioned. This covers all the filament members projecting from the longitudinal axis of the yarn, especially also the loops formed during intermingling and/or the self-crossing slings.

An especially well-suited embodiment of the inventive yarn which is usable as sewing yarn in an excellent manner includes the feature of a definite arrangement of the first and of the second yarn component. Viewed over the cross-section of the spun yarn, the second yarn component covers an area $F_2$ which is two times up to thirty times, especially five times up to fifteen times, as large as the area $F_1$ which is covered by the first yarn component (at the same cross-sectional area). In order to ascertain these two values $F_1$ and $F_2$, a plurality of cross-sections, especially 50 to 150, is produced of the spun yarn along a predetermined length, especially along a length of 1 m up to 4 m. Subsequently, the area $F_1$ covered by the first yarn component is determined in each cross-section by drawing a circle with the smallest possible radius in such a manner that all filaments of the first yarn component are located within this circle. Thereafter, the area $F_1$ is calculated at this concrete cross-section under consideration of the above-cited smallest possible radius. The corresponding value for the area $F_1$ results from the mean value formation of the several cross-sectional areas. Exactly according to the same method the mean value of the cross-sectional area $F_2$ covered by the monofilaments of the second yarn component is determined, wherein the drawing of the second circular area $F_2$ is realized such that the center of the second circular area is fed into the center of the first circular area with each cross-section. Corresponding tests with sewing yarn, according to which the ratio of the mean value of the area $F_1$ to the mean value of the area $F_2$ is from 1:2 to 1:30 and especially from 1:5 up to 1:15, have shown that such yarns have a significantly improved running behaviour at all sewing operations which is characterized by a significantly reduced frequency of thread breaks and corresponding few standstills of the sewing machines.

Furthermore, the present invention has the objective to provide a method of the cited kind by means of which the above-described inventive yarn can be produced in an especially simple and economical manner.

According to the inventive method of producing a yarn, especially a sewing yarn, at least one first multifile yarn component is intermingled with at least one second multifile yarn component by a fluid stream, especially a gas stream. According to the inventive method, as second yarn component a yarn material is selected the monofilaments of which have a specific strength (tensile strength) of between 5% and 70%, preferably of between 10% and 50%, of the specific strength of the monofilaments of the first yarn component.

As already described above in connection with the inventive yarn, according to the inventive method one can either select such a material for the second yarn component which has the above-described strength viewed along the whole length of the filaments, or a material can be selected which, viewed along the length of the filaments, has uniformly or non-uniformly distributed first areas in which the filaments have the above-cited specific strength. Such first areas, which have been also designated above predetermined breaking points, can be produced in different manners.

So, according to a first alternative of the inventive method the multifile material of the second yarn component is non-uniformly drawn, viewed along the length of the second yarn component, prior to intermingling with the first yarn component for the production of the first areas. Preferably, here the monofilaments of the second yarn component are drawn to a less extent in the first areas. With customary drawing means this can be achieved, for example, by asymmetrically supporting the drawing-off galette (two rollers) around which the multifilament yarn, which is to be drawn, is guided. This has the result that at each rotation of the drawing-off galette, the multifilament yarn of the second yarn component guided around the same forms a first area (predetermined breaking point) which is drawn less so that the material in this first area has the above-cited specific strengths. Preferably, the drawing-off galette is asymmetrically supported such that a drawing ratio is generated which is between 30% and 90%, preferably between 60% and 80%, below the customary drawing ratio.

A second alternative of the inventive method provides the thermal treatment of a relative short distance viewed along the length of the yarn, which is preferably between 0.01 mm and 0.5 mm, for producing the first areas (predetermined breaking points) in the multifilament yarn of the second yarn component. By this, in the first area the corresponding yarn material is thermally deteriorated which has the result that the strength is correspondingly reduced in this first area.

Preferably, according to the above-described alternative of the inventive method the thermal treatment at the multifilament yarn of the second yarn component is carried out prior to the intermingling of the second yarn component with the first yarn component. However, it is of course also possible to carry out such a thermal treatment at the yarn which is already intermingled since the second yarn component is predominantly disposed in the jacket of the yarn. The thermal treatment of the corresponding first areas can be carried out either by direct contact of the yarn component to be treated or of the spun yarn with a corresponding heating element or in an indirect manner, wherein in the last-cited case a contact-free treatment with pulsed laser beams is especially suited.

According to another alternative of the inventive method the multifilament yarn of the second yarn component is chemically degraded in the first areas, preferably by hydrolysis, for the generation of the first areas. This has the result that the mean molecular weight of the yarns treated in such a manner is significantly reduced in the first areas compared with the adjacent areas, for example for about 30% up to about 60%, so that the yarn material in the first areas necessarily gets a corresponding loss of strength.

Preferably, according to this embodiment of the inventive method an acid, especially an inorganic acid, as for example hydrochloric acid, nitric acid or sulfuric acid, or a lye, preferably soda lye, is applied to the multifilament yarn of the second yarn component in certain areas in a concentration of between 1% and 10%, related to the weight of the yarn, prior to intermingling. Such an application of an acid or lye can be carried out for example by a spraying method or by means of a roller which, viewed in circumferential direction, is provided with at least one raised portion extending in radial direction. After the application of the acid or the lye a dwell time of some seconds or preferably a thermal treatment at a temperature of between 150° and 240° C., preferably at 170° to 190° C., follows, wherein these dwell times vary between 0.1 s and 30 s dependent on the temperature.

Preferred embodiments of the inventive yarn and of the inventive method are indicated in the subclaims.

BRIEF DESCRIPTION OF THE DRAWINGS

In the following the inventive yarn and the inventive method are discussed in detail by means of the drawing and by means of an example.

Of the drawing

DETAILED DESCRIPTION OF THE INVENTION

Figure 1A:
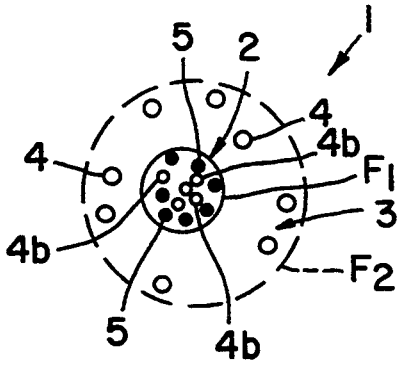
FIGS. 1*a*–1*c* show schematic cross-sectional views of a first embodiment.
Figure 1B:
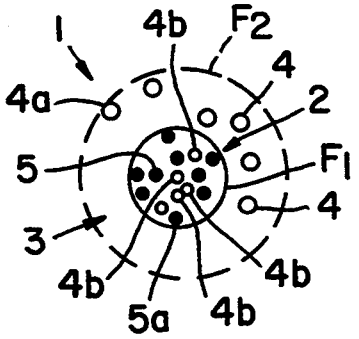
Figure 1C:
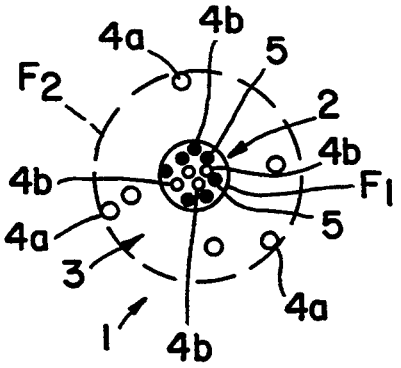

FIGS. 1*a* to 1*c* show diagrammatically typical cross-sections of a yarn at different locations of this yarn. In the FIGS. 1*a* to 1*c* the yarn is generally designated with 1. The shown yarn is a yarn which is used as sewing yarn. It consists of a first yarn component 2 which is located in the core of the yarn 1. The first yarn component 2 comprises 36 monofilaments 5. However, FIGS. 1*a* to 1*c* show only a part of the filaments 5. The monofilaments 5 form the first yarn component 2 and are located relatively closely with respect to one another. For a clear distinction they are shown completely black. The whole titre of the first yarn component is 200 dtex, and the specific strength is 62 cN/tex.

The first yarn component 2 is surrounded by a second yarn component 3. This second yarn component (jacket) has also a plurality of monofilaments 4 of which also only a part is shown. In contrast to the yarn component 2, the second yarn component 3 has 48 filaments 4 in the embodiment shown in FIGS. 1*a* to 1*c*. About 60%–90% of the filaments 4 of the second yarn component 3 are intermingled with the filaments 5 of the first yarn component 2, i. e. in the cross-sectional views these filaments 4 are located in the range of the core of the yarn and thus within the area $F_1$, which is expressed in FIGS. 1*a*–1*c* by the location of filaments 4*b* of the second yarn component 3 within the area of the first yarn component 2. The remaining portion, i. e. about 10% up to 40% of the filaments 4 of the second yarn component 3, is located outside of the area $F_1$, which is shown in FIGS. 1*a*–1*c* by the reference number 4. The specific strength of each monofilament 4 of the second yarn component 3 is about 35% of the specific strength of each filament 5 of the first yarn component 2.

Along a yarn length of 4 m 100 cross-sections were produced for ascertaining the area $F_1$, which is covered by the filaments 5 of the first yarn component 2 and which is defined by the non-interrupted line in FIGS. 1*a* to 1*c*, and the area $F_2$, which is covered by the filaments 4 of the second yarn component 3 (covering or jacket) and which is defined by the dotted line. Over each cross-section two circular areas were arranged, respectively, wherein the first circular area $F_1$, characterized by the non-interrupted line in FIGS. 1*a* to 1*c*, was selected such that with the smallest possible radius all the filaments 5 of the first yarn component 2 are located within this circular area $F_1$. In a similar manner the second circular area $F_2$ was arranged in the cross-section such that the center of the second circular area $F_2$ falls at the center of the first circular area $F_1$ and that all the filaments 4, 4*a* of the second yarn component 3 (jacket) are located within the circular area $F_2$ with the smallest possible radius, as this is expressed in FIGS. 1*a* to 1*c* by the dotted line.

The mean value was calculated from the 100 areas $F_1$ and the 100 areas $F_2$ determined in such a manner, respectively. These mean values were compared with one another so that a ratio $F_1$:$F_2$ of 1:6.4 resulted with the shown embodiment.

The cross-sections shown in FIGS. 1*a* to 1*c* are typical examples for the variance of the possible cross-sections which can be present in a yarn along the length of the same. So, the schematic representations of FIGS. 1*a* and 1*c* show cross-sectional shapes according to which the first yarn component 2 is relatively compact which is expressed by relative small areas $F_1$. This is in contrast to the schematic cross-sectional view according to FIG. 1*b* in which the first yarn component 2 has a relatively open structure and thus a relative large area $F_1$. The filaments 4 of the second yarn component 3 are relatively uniformly distributed over the area $F_2$ according to the schematic cross-section according to FIG. 1*a*. According to the cross-sectional shape of FIG. 1*b* a relatively non-uniform distribution of the monofilaments 4 is present which is expressed by the fact that also monofilaments 4*a* are positioned relatively far away from the first yarn component. The cross-sectional view of FIG. 1*c* confirms this in a more significant manner. Here, three filaments 4*a* are present which are located at the outest edge of the interrupted demarcation line of the area $F_2$ so that the area $F_2$ is correspondingly large.

Figure 2:
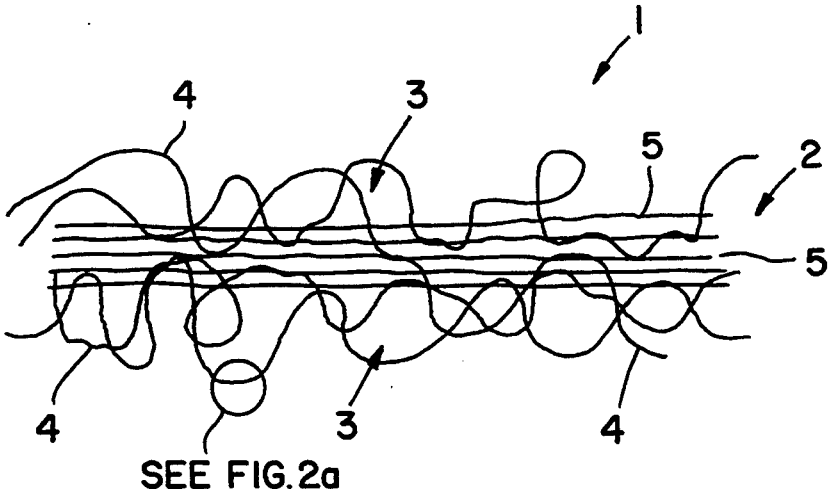
FIGS. 2–2*a* shows schematic side views of a further embodiment of the yarn.

FIG. 2 shows schematicly a further embodiment of a yarn 1 in a side view. This yarn 1 consists of a first yarn component 2 having 36 monofilaments 5 and positioned within the core of the yarn 1. As shown in FIG. 2, the monofilaments 5 extend in nearly elongated shape in the direction of the longitudinal axis of the yarn 1. The monofilaments 4 of the second yarn component are intermingled with these monofilaments 5 of the first yarn component 2, wherein the monofilaments 2 of the second yarn component form loops, slings, self-crossing loops and arcs. By this, the cross-sectional area $F_2$ schematically shown in FIG. 1 is formed.

Figure 2A:
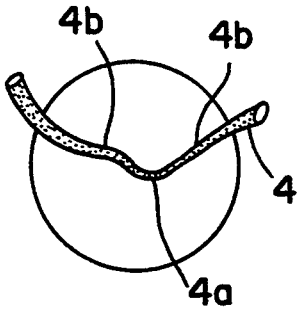

As shown in the enlargement of FIG. 2*a*, each monofilament 4 of the second yarn component 3 had first areas 4*a* of which a plurality are provided in longitudinal direction of the monofilaments 4 and which are spaced from one another.

In these first areas 4*a* the titre of the monofilament 4 is reduced for about 20 to about 60%, in the shown embodiment for about 40%, compared with adjacent areas 4*b*, which has the result that the monofilaments in the first areas 4*a* break if the material of the jacket hooks or sticks during the processing. Accordingly, the first areas 4*a* serve as predetermined breaking points. The following example shows a method how such areas 4*a* are produced.

EXAMPLE

A sewing yarn was produced, wherein this sewing yarn had a pre-drawn polyester multifilament yarn with an elementary thread number of 32 and a titre of 200 dtex. The specific strength of this core material was 60 cN/tex. This polyester multifilament core yarn was intermingled with a second yarn component (effect yarn) in a customary nozzle so that the formed sewing yarn had self-crossing slings and loops. The effect yarn (polyester multifilament yarn) had an elementary thread number of 42 and a titre of 96 dtex. Prior to intermingling the filaments of the effect yarn were spread such that the monofilaments were positioned parallel one besides the other. A 5% soda lye was sprayed in areas over a distance of 0.05 mm onto the spreaded filaments by means of a corresponding nozzle. The absorption was 100 % (related to the weight of the yarn). Subsequently, the effect yarn treated in such a manner was continuously passed through a heated tube. The dwell time within the heated tube was 5 s. The temperature of the heated tube was adjusted to 200° C. By this, the above-described areas 4a were generated in the effect yarn. Measurements of strength with samples of the effect yarn after leaving the heating tube had the result that the specific strength of the monofilaments of the effect yarn component was lower for 40% than the specific strength of the monofilaments of the core yarn.

Compared with this, a second sewing yarn was produced which had the above-described identical effect and core yarn components. However, in contrast to the foregoing, the effect yarn was not treated with soda lye and thus did not have any first areas.

Sewing tests industrially carried out showed that the comparison yarn had a frequency of thread breakages which was for about 40% higher than the sewing yarn having the above-described first areas 4a under conditions of reverse sewing and multidirectional sewing at stitch numbers of between 4,000 and 6,000 stitches per minute. The ground for this is seen in the fact that the projecting capillaries of the effect yarn components, which hook or stitch in an undesired manner during sewing, immediately break on account of the first areas so that no thread material shiftings occurred.

We claim:

1. A yarn comprising at least first and second multifile yarn components each of which comprises a plurality of monofilaments, said first yarn component forming mainly a core of said yarn and said second yarn component forming mainly a jacket of said yarn surrounding said core, said first and second yarn components also being intermingled with one another, the monofilaments of said second yarn component having a specific strength which amounts to between 5% and 70% of the specific strength of the monofilaments of said first yarn component, wherein said jacket has a cross-sectional area ($F_2$) which is 2 to 30 times as large as a cross-sectional area ($F_1$) of said core.

2. The yarn of claim 1 wherein the specific strength of the monofilaments of said second yarn component amounts to between 10% and 50% of the specific strength of the monofilaments of said first yarn component.

3. The yarn of claim 1 wherein said first and second yarn components comprise the same material but said second yarn component has a lower degree of polymerization than said first yarn component, whereby the monofilaments of said second yarn component have a mean molecular weight which is between 5% and 50% below the mean molecular weight of the monofilaments of said first yarn component.

4. The yarn of claim 3 wherein the mean molecular weight of the monofilaments of said second yarn component is between 15% and 25% below the mean molecular weight of the monofilaments of said first yarn component.

5. The yarn of claim 1 wherein the monofilaments of said second yarn component has predetermined breaking points at which the specific strength of the monofilaments of said second yarn component amounts to between 5% and 70% of the specific strength of the monofilaments of said first yarn component.

6. The yarn of claim 5 wherein the specific strength of the monofilaments of said second yarn component at said predetermined breaking points amounts to between 10% and 50% of the specific strength of the monofilaments of said first yarn component.

7. The yarn of claim 1 wherein the monofilaments of said second yarn component have an absolute monofilament strength which is less than 3.5 cN.

8. The yarn of claim 7 wherein the absolute monofilament strength of the monofilaments of said second yarn component is between 0.5 cN and 3 cN.

9. The yarn of claim 8 wherein the absolute monofilament strength of the monofilaments of said second yarn component is between 0.8 cN and 2 cN.

10. The yarn of claim 1 wherein said second yarn component has a monofilament titre of between 0.4 dtex and 1.4 dtex.

11. The yarn of claim 10 wherein the monofilament titre of said second yarn component is between 0.5 dtex and 0.7 dtex.

12. The yarn of claim 1 wherein said first yarn component has a specific strength of between 40 cN/tex and 270 cN/tex.

13. The yarn of claim 12 wherein said first yarn component has a specific strength between 60 cN/tex and 120 cN/tex.

14. The yarn of claim 1 wherein said first yarn component has a monofilament titre of between 0.4 dtex and 5 dtex.

15. The yarn of claim 14 wherein the monofilament titre of said first yarn component is between 0.8 dtex and 4 dtex.

16. The yarn of claim 1 wherein said first yarn component has an elementary thread number between 16 and 300.

17. The yarn of claim 16 wherein the elementary thread number of said first yarn component is between 24 and 96.

18. The yarn of claim 1 wherein said second yarn has an elementary thread number between 20 and 400.

19. The yarn of claim 18 wherein the elementary thread number of said second yarn component is between 36 and 120.

20. The yarn of claim 1 wherein said first yarn component comprises ultra-strong fibers selected from the group consisting of polyamide fibers, carbon fibers, glass fibers, silicate fibers, aramide fibers, polyethylene fibers, polypropylene fibers, and mixtures thereof.

21. The yarn of claim 20 wherein said first yarn component comprises ultra-strong gel-spun polyethylene fibers.

22. The yarn of claim 1 wherein said second yarn component comprises fibers selected from the group consisting of polyester fibers, nylon 6-fibers, nylon 66-fibers, polyacrylnitrile fibers, and mixtures thereof.

23. The yarn of claim 1 wherein said jacket has a cross-sectional area ($F_2$) which is 5 to 15 times as large as a cross-sectional area ($F_1$) of said core.

24. The yarn of claim 1 wherein a weight ratio of said first yarn component to said second yarn component is in the range between about 90:10 and 50:50.

25. The yarn of claim 24 wherein the weight ratio of said first yarn component to said second yarn component is in the range between about 80:20 and 60:40.

26. The yarn of claim 1 having a total titre of between 50 dtex and 500 dtex.

27. The yarn of claim 26 having a total titre of between 80 dtex and 300 dtex.

* * * * *